US009959968B2

(12) United States Patent
Kuroda et al.

(10) Patent No.: US 9,959,968 B2
(45) Date of Patent: May 1, 2018

(54) REACTOR

(71) Applicant: TDK CORPORATION, Tokyo (JP)

(72) Inventors: Tomofumi Kuroda, Tokyo (JP); Yu Sakurai, Tokyo (JP)

(73) Assignee: TDK CORPORATION, Tokyo (JP)

( * ) Notice: Subject to any disclaimer, the term of this patent is extended or adjusted under 35 U.S.C. 154(b) by 273 days.

(21) Appl. No.: 14/604,380

(22) Filed: Jan. 23, 2015

(65) Prior Publication Data

US 2015/0213944 A1 Jul. 30, 2015

(30) Foreign Application Priority Data

Jan. 28, 2014 (JP) ..... 2014-013329
Nov. 4, 2014 (JP) ..... 2014-224434

(51) Int. Cl.

| | |
|---|---|
| ***H01F 17/06*** | (2006.01) |
| ***H01F 21/08*** | (2006.01) |
| ***H01F 27/24*** | (2006.01) |
| ***H01F 27/26*** | (2006.01) |
| ***H01F 27/255*** | (2006.01) |
| ***H01F 27/34*** | (2006.01) |
| ***H01F 3/10*** | (2006.01) |
| ***H01F 37/00*** | (2006.01) |
| *H01F 3/14* | (2006.01) |

(52) U.S. Cl.

CPC ..... *H01F 27/263* (2013.01); *H01F 3/10* (2013.01); *H01F 27/255* (2013.01); *H01F 27/34* (2013.01); *H01F 37/00* (2013.01); *H01F 3/14* (2013.01); *H01F 27/346* (2013.01); *H01F 2003/106* (2013.01)

(58) Field of Classification Search

CPC ..... H01F 38/10; H01F 3/14; H01F 27/245
USPC ..... 336/165, 178, 212, 219
See application file for complete search history.

(56) References Cited

U.S. PATENT DOCUMENTS 3,366,907 A * 1/1968 Tipton ..... H01F 27/303 336/197
5,062,197 A * 11/1991 Charles ..... H01F 3/10 29/606

(Continued)

FOREIGN PATENT DOCUMENTS

JP 2007-128951 A 5/2007
JP 2009-071248 A 4/2009

(Continued)

*Primary Examiner* — Tsz Chan
(74) *Attorney, Agent, or Firm* — Oliff PLC

(57) ABSTRACT

A reactor uses a composite magnetic core which combines a ferrite core and a soft magnetic metal core. The reactor is composed of a pair of yoke portion cores composed of ferrite cores, winding portion core(s) disposed between the opposite planes of the yoke portion cores, and coil(s) wound around the winding portion core(s). Flange-like members are disposed at the end part of the winding portion core(s) in a way of being external connected with the periphery of winding portion core(s) which is composed of a soft magnetic metal core. The flange-like member is composed of a metal material with iron as the main component which can be magnetically attracted to a magnet, and a junction portion of the flange-like member and the yoke portion core is formed at one flat plane of the member which is the same plane with an end plane of the winding portion core.

8 Claims, 5 Drawing Sheets

(56) References Cited

U.S. PATENT DOCUMENTS

| | | | | |
|---|---|---|---|---|
| 6,927,658 | B2 * | 8/2005 | Okamoto | H01F 17/045 336/192 |
| 7,057,486 | B2 * | 6/2006 | Kiko | H01F 17/043 336/178 |
| 2009/0315660 | A1 * | 12/2009 | Oki | H01F 17/045 336/192 |
| 2012/0200382 | A1 * | 8/2012 | Hejny | H01F 3/10 336/212 |

FOREIGN PATENT DOCUMENTS

| | | | |
|---|---|---|---|
| JP | 2011-222711 | A | 11/2011 |
| JP | 2013-157352 | A | 8/2013 |

* cited by examiner

REACTOR

The present invention relates to a reactor used in a power supply circuit or a power conditioner of a solar electrical energy generation system or the like. Specifically, the present invention relates to a reactor with an improved DC superposition characteristic of the inductance.

BACKGROUND

As a conventional magnetic core material for the reactor, a stacked electromagnetic steel plate or a soft magnetic metal power core can be used. Although the stacked electromagnetic steel plate has a high saturation magnetic flux density, the iron loss becomes greater if the driving frequency of the power supply circuit exceeds 10 kHz, causing the decrease of efficiency. The soft magnetic metal powder core is widely used with the driving frequency being higher because its iron loss at a high frequency is less than the stacked electromagnetic steel plate. However, the iron loss may not be low enough, and some problems are there such as its saturation magnetic flux density is inferior to that of the electromagnetic steel plate.

On the other hand, the ferrite core is well known as a material for magnetic core with a small iron loss at a high frequency. However, the ferrite core has a lower saturation magnetic flux density compared to the stacked electromagnetic steel plate or the soft magnetic metal powder core, so a design is needed to provide a relatively large sectional area of the core so as to avoid the magnetic saturation when a large current is applied. In this respect, a problem arises that the shape becomes larger.

In Patent Document 1, a reactor has been disclosed which uses a composite magnetic core as the material for the magnetic core so that the loss, size and the weight of the magnetic core are reduced, wherein the composite magnetic core is obtained by combining a soft magnetic metal powder core which is used for the coil winding portion and a ferrite core which is used for the yoke portion.

PATENT DOCUMENT

Patent Document 1: JP-A-2007-128951

SUMMARY

The loss at a high frequency will decrease when a composite magnetic core is prepared by combining the ferrite core and the soft magnetic metal core. However, when the Fe powder magnetic core or the FeSi alloy powder magnetic core with a high saturation magnetic flux density is used as the soft magnetic metal core, the composite magnetic core in which the soft magnetic metal core and the ferrite core are combined will have an inferior DC superposition characteristic of the inductance compared to the case in which the soft magnetic metal core is only used. As described in Patent Document 1, since the saturation magnetic flux density of the ferrite core is lower than that of the soft magnetic metal core, a certain improved effect has been provided by increasing the sectional area of the ferrite core. However, the problem has not been fundamentally solved.

FIG. 4 and FIG. 5 show an example of the embodiment in the prior art. FIG. 4 and FIG. 5 are used to find out the reason why the DC superposition characteristic of the inductance deteriorates in the composite magnetic core in which the ferrite core and the soft magnetic metal core are combined. FIG. 4 and FIG. 5 schematically show the configuration of the junction portion of the ferrite core 21 and the soft magnetic metal core 22 as well as the flow of magnetic flux 23.

The arrows in the drawings represent the magnetic flux 23. When the magnetic flux 23 of the soft magnetic metal core 22 is equivalent to that of the ferrite core 21, the number of the arrows is the same in these two magnetic cores. The magnetic flux 23 per unit area is referred to as the magnetic flux density. Thus, the narrower the interval between arrows is, the higher the magnetic flux density is.

As the ferrite core 21 has a lower saturation magnetic flux density compared to the soft magnetic metal core 22, the sectional area perpendicular to the direction of the magnetic flux in the ferrite core 21 is set to be larger than that in the soft magnetic metal core 22 so as to enable a large magnetic flux to flow in the ferrite core. The end part of the soft magnetic metal core is coupled with the ferrite core, and the area of the part in which the soft magnetic metal core 22 and the ferrite core 21 face to each other is the same as the sectional area of the soft magnetic metal core 22.

FIG. 4 shows the case that a current flowing in the coil is small, i.e., the case that the magnetic flux 23 excited by the soft magnetic metal core of the winding portion is low. As the magnetic flux density of the soft magnetic metal core 22 is lower than the saturation magnetic flux density of the ferrite core 21, the magnetic flux 23 flowing from the soft magnetic metal core 22 can directly flow into the ferrite core 21 without the leakage of the magnetic flux 23. When the current flowing in the coil is low, the decrease of the inductance can be inhibited to be low.

FIG. 5 shows the case that the current flowing in the coil is high, i.e., the case that the magnetic flux excited by the magnetic core of the winding portion is high. If the magnetic flux density of the soft magnetic metal core 22 is higher compared to the saturation magnetic flux density of the ferrite core 21, the magnetic flux 23 flowing from the soft magnetic metal core 22 cannot directly flow into the ferrite core 21 through the junction portion. Instead, the magnetic flux 23 flows through the surrounding space as shown by the dotted arrows. In other words, the magnetic flux 23 flows in the space with a relative permeability of 1, so the effective permeability decreases and the inductance also decreases sharply. That is, when a high current is superimposed to make the magnetic flux density of the soft magnetic metal core 22 larger than the saturation magnetic flux density of the ferrite core 21, there is a problem that the inductance decreases. In addition, as the leakage of the magnetic flux 23 happens, the problem also arises that the cupper loss increases due to the magnetic flux being interlinked with the coil.

As such, only the sectional areas of the ferrite core and the soft magnetic metal core are considered in the prior art, so the magnetic saturation in the junction portion is neglected, and the DC superposition characteristic of the inductance is not sufficient.

The present invention is made to solve the problems mentioned above and aims to improve the DC superposition characteristic of the inductance in the reactor using a composite magnetic core in which the ferrite core and the soft magnetic metal core are combined.

The reactor of the present invention is composed of a pair of yoke portion cores which are made of the ferrite cores, winding portion core(s) disposed between the plane opposite to the yoke portion cores, and coil(s) wound around the winding portion core(s), wherein flange-like members are disposed at the end part of the winding portion core(s) in a way of being external connected with the periphery of the winding portion core(s), each of the winding portion core(s) is composed of a soft magnetic metal core, each of the flange-like members is composed of a metal material having iron as the main component which can be magnetically attracted to a magnet, and a junction portion of each of said flange-like members and each of said yoke portion cores is formed at one flat plane of each of said flange-like members which is the same plane with an end plane of each of said winding portion core(s). As such, the DC superposition characteristic of the inductance can be improved in the reactor using a composite magnetic core in which the ferrite core and the soft magnetic metal core are combined.

Further, the flange-like member in the reactor of the present invention is preferably composed of a soft magnetic metal powder core. In this way, the increase of the loss at a high frequency can be inhibited.

In addition, the flange-like member in the reactor of the present invention is preferably composed of a steel plate in which a notch from the inner peripheral end to the outer peripheral end is disposed at a place in the peripheral direction. And thus, a steel plane with a high strength can be used, and the increase of the loss at a high frequency can be inhibited.

According to the present invention, the DC superposition characteristic of the inductance can be improved in the reactor using the composite magnetic core in which the ferrite core and the soft magnetic metal core are combined.

DETAILED DESCRIPTION OF EMBODIMENTS

Figure 6:
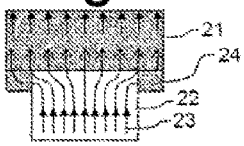
FIG. 6 a drawing schematically showing the configuration of the junction portion of the ferrite core and the soft magnetic metal core as well as the flow of the magnetic flux according to one embodiment of the present invention.

In the composite magnetic core of the present invention in which the ferrite core and the soft magnetic metal core are combined, the inductance under DC superposition can be increased by preventing the magnetic saturation of the ferrite on the plane where the magnetic flux flows to and fro between the ferrite core and the soft magnetic metal core. FIG. 6 is used to describe the improved effect on the DC superposition characteristic of the inductance provided by the present invention.

In FIG. 6, a flange-like member 24 is disposed in a way of being external connected with the periphery of the end part of the soft magnetic metal core 22, and the flange-like member 24 is characterized in that it is composed of a metal material having iron as the main component which can be attracted to a magnet.

The magnetic flux will easily pass through the flange-like member 24 since this member is composed of a metal material which can be attracted to a magnet. Also, the flange-like member 24 has iron as the main component so that the saturation magnetic flux density is high. In addition, as the flange-like member 24 is disposed in a way of being external connected with the periphery of the end part of the soft magnetic metal core 22, the magnetic flux can flow to the ferrite core 21 through this flange-like member 24 even if the magnetic flux density of the coil winding portion of the soft magnetic metal core 22 is higher than the saturation magnetic flux density of the ferrite core 21. The magnetic flux 23 flowing from the soft magnetic metal core 22 will flow into the ferrite core 21 through the flange-like member 24 without leakage to the surrounding space so that the effective permeability can be prevented from decreasing. As a result, a high inductance can be obtained even under DC superposition.

The preferable embodiments of the present invention will be described with reference to the drawings hereinafter.

Figure 1A:
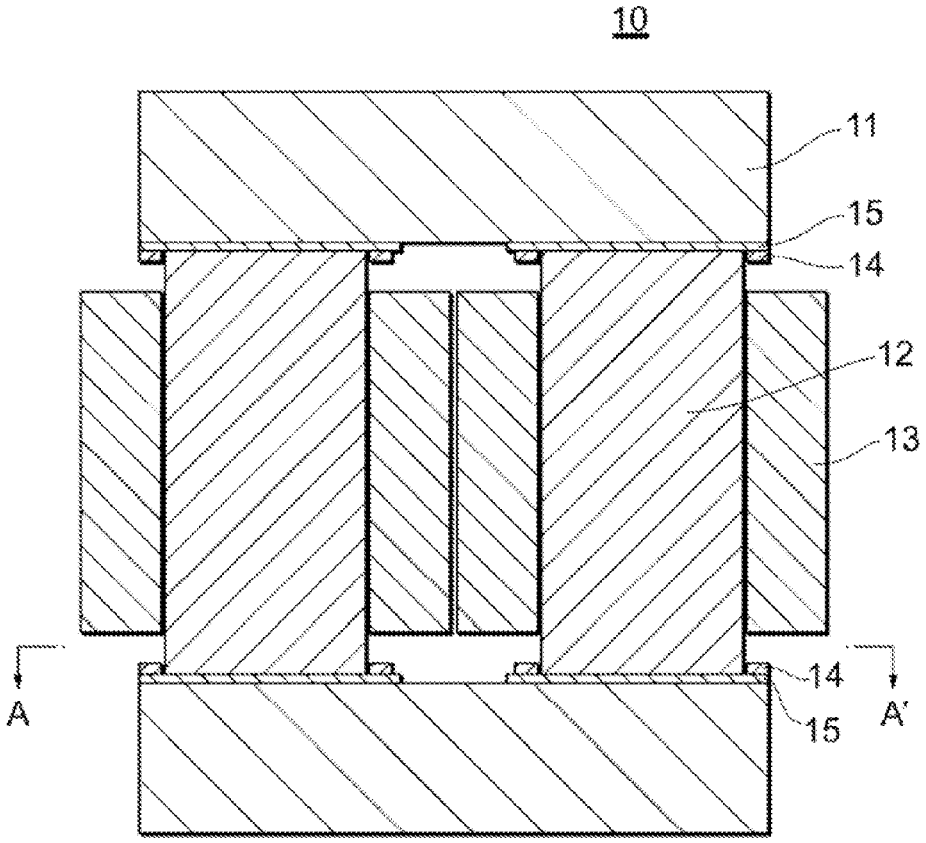
FIGS. 1A and 1B are a sectional view showing the configuration of the reactor according to one embodiment of the present invention.
Figure 1B:
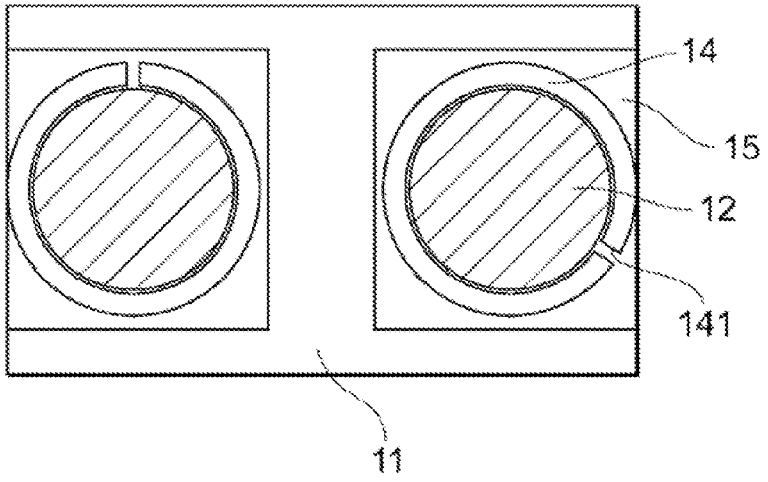

FIGS. 1A and 1B are a drawing showing the configuration of the reactor 10. The reactor 10 is provided with two yoke portion cores 11 opposite to each other, winding portion cores 12 disposed between the two yoke portion cores 11, and coils 13 winding around the winding portion cores 12. In addition, a flange-like member 14 is disposed at the end part of the winding portion core 12 in a way of being external connected with the periphery of the winding portion core 12. More preferably, the flange-like member 14 is disposed at both ends of the winding portion core 12. The coil 13 can also be wound around a bobbin.

The ferrite core is used for the yoke portion 11. The ferrite core has a extremely low loss but a low saturation magnetic flux density compared to the soft magnetic metal core. As no coil 13 will be wound around the yoke portion core 11, the size of the coil 13 will not be affected even if the width or the thickness of the yoke portion core is increased. Thus, the low saturation magnetic flux density will be covered by increasing the sectional area of the yoke portion core 11. The sectional area of the yoke portion core 11 refers to the sectional area perpendicular to the direction of the magnetic flux, and the sectional area is obtained by multiplying the width by the thickness. As the ferrite core is easier to be molded than the soft magnetic metal core, it will be quite easy to prepare a magnetic core with a large sectional area. The MnZn based ferrite is preferably used as the ferrite core. The MnZn based ferrite is good for the miniaturization of the magnetic core because it has a less loss and a higher saturation magnetic flux density than other ferrites.

The soft magnetic metal core is used for winding portion core 12. The iron powder magnetic core or the FeSi alloy powder magnetic core, the stacked electromagnetic steel plate or the amorphous magnetic core are preferably used as the soft magnetic metal core. Such soft magnetic metal cores have a higher saturation magnetic flux density than the ferrite core, so the sectional area of the magnetic core can be reduced which is good for the miniaturization.

The flange-like member 14 uses a metal material having iron as the main component which can be attracted to a magnet. The flange-like member 14 can be attracted to a magnet, so the magnetic flux will easily flow through it. Also, as the flange-like member 14 uses iron as the main component, its saturation magnetic flux density is high and a large magnetic flux can flow through it. Such a metal material is not necessarily the so-called soft magnetic metal (e.g., an electromagnetic soft iron, an electromagnetic steel plate, an iron powder magnetic core, an iron alloy powder magnetic core or the like), and a carbon steel, a cold-rolled steel plate, a magnetic stainless steel or the like which are used as the structural material or the metal parts can also be used. Whether it is capable of being attracted to a magnet or not can be determined as follows. For example, when a magnetic pushpin which is a kind of commercially available office supplies is kept in contact with the flange-like member 14 which stays still, and then the magnetic pushpin is lifted up, it can be deemed to be capable of being attracted to a magnet if the flange-like member 14 is also lifted up via the attraction of the magnet.

FIGS. 7 to 13 describe the preferable shapes of the flange-like member 14. The flange-like member 14 is tabular with a penetration part via which it can be external connected with the periphery of the end part of the winding portion core 12. It is fundamental that the shape of the inner periphery of the penetration part in the flange-like member 14 is similar to that of the outer periphery of the winding portion core 12. The shape of the outer periphery of the flange-like member 14 can be any shape. If the availability or the ease of preparation is to be considered, the outer periphery is preferred to be circular, elliptical or quadrilateral. In the examples shown in FIGS. 7 to 13, the case is shown that the periphery at the end part of the winding portion core 12 is circular. In the embodiment shown in FIG. 7, the inner periphery and the outer periphery are both circular, and the flange-like member has a shape like the part usually called as the spacer, the washer, the shim ring, the collar or the like.

Figure 7:
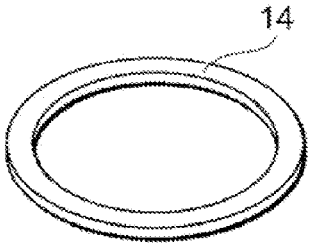
FIG. 7 is a perspective view schematically showing the flange-like member according to one embodiment of the present invention.
Figure 8:
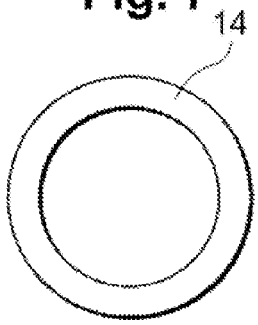
FIG. 8 is a plane view showing the projection plane of the flange-like member relative to the yoke portion core according to one embodiment of the present invention.
Figure 9:
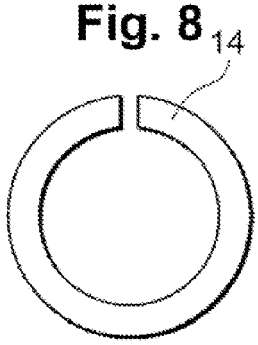
FIG. 9 is a plane view showing the projection plane of the flange-like member relative to the yoke portion core according to one embodiment of the present invention.
Figure 10:
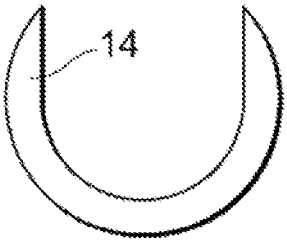
FIG. 10 is a plane view showing the projection plane of the flange-like member relative to the yoke portion core according to one embodiment of the present invention.
Figure 11:
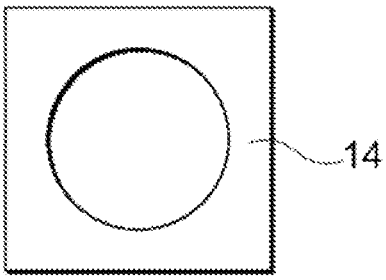
FIG. 11 is a plane view showing the projection plane of the flange-like member relative to the yoke portion core according to one embodiment of the present invention.
Figure 12:
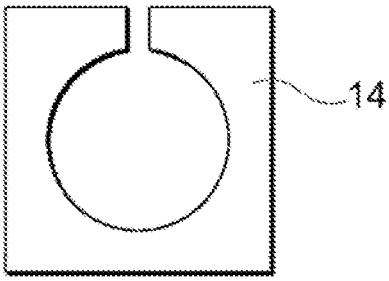
FIG. 12 is a plane view showing the projection plane of the flange-like member relative to the yoke portion core according to one embodiment of the present invention.
Figure 13:
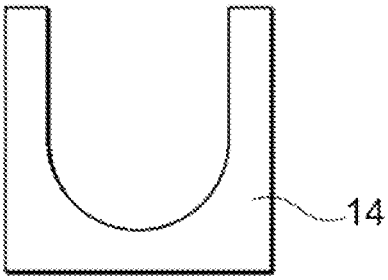
FIG. 13 a plane view showing the projection plane of the flange-like member relative to the yoke portion core according to one embodiment of the present invention.

FIG. 8 is a drawing showing the projection plane of the flat plane in the flange-like member shown in FIG. 7. FIG. 9 shows a modified example of that in FIG. 8. Specifically, a notch from the inner peripheral end to the outer peripheral end is disposed at a place in the peripheral direction of the flange-like member. FIG. 10 shows a modified example of that in FIG. 9. Specifically, the width of the notch from the inner peripheral end to the outer peripheral end disposed at a place in the peripheral direction is increased to be equal to the inner diameter. FIG. 11 shows a modified example of that in FIG. 8. Specifically, the outer periphery becomes quadrilateral. FIG. 12 shows a modified example of that in FIG. 11. Specifically, a notch from the inner peripheral end to the outer peripheral end is disposed at a place in the peripheral direction of the flange-like member. FIG. 13 shows a modified example of that in FIG. 12. Specifically, the width of the notch from the inner peripheral end to the outer peripheral end disposed at a place in the peripheral direction is increased to be equal to the inner diameter.

When the soft magnetic metal powder core such as the iron powder magnetic core or the FeSi alloy powder magnetic core is used for the flange-like member 14, any shape shown in FIGS. 8 to 13 can be used. Since the soft magnetic metal powder core has a high saturation magnetic flux density, the flow of the magnetic flux can be sufficiently improved. In addition, the resistance of the soft magnetic metal powder core is relatively high and the eddy current is hardly flow in the plane of the tabular flange-like member 14, so the inductance at a high frequency will not decrease and the loss also will not increase. Especially, the tabular flange-like member 14 can be molded even if a relatively low stress is applied, and thus the iron powder magnetic core is preferably used as the soft magnetic metal powder core.

With respect to the flange-like member 14, the electromagnetic soft iron, the electromagnetic steel plate, the carbon steel, the cold-rolled steel plate, the ferrite based stainless steel or the like is magnetic. The notch from the inner peripheral end to the outer peripheral end is preferably disposed at a place in the peripheral direction of the flange-like member as shown in FIG. 9, FIG. 10, FIG. 12 and FIG. 13 when the iron based metal material with a low in-plane resistance at a flat plane is used. Since these metal materials have a high saturation magnetic flux density, the flow of the magnetic flux will be sufficiently improved. However, the resistance is low and the eddy current will flow in the plane, and thus the inductance at a high frequency will reduce so that the loss tends to increase. Therefore, the flow of the eddy current will be cut off by disposing the notch from the inner peripheral end to the outer peripheral end at a place in the peripheral direction of the flange-like member. In this way, the inductance will not decrease even at a high frequency, and the loss can be prevented from increasing.

The flange-like member 14 is preferably disposed in a way of being external connected with (i.e., being in contact with) the periphery of the end part of the winding portion core 12. Also, a little space can be there between the inner periphery of the flange-like member 14 and the outer periphery of the winding portion core 12. The space between the inner periphery of the flange-like member 14 and the outer periphery of the winding portion core 12 is preferably 0.5 mm or less. If the space between the inner periphery of the flange-like member 14 and the outer periphery of the winding portion core 12 is larger than 0.5 mm, the magnetic flux can hardly flow in the space and thus the magnetic flux passing through the flange-like member is reduced. In this way, the inductance under DC superposition deteriorates. The narrower the space between the inner periphery of the flange-like member 14 and the outer periphery of the winding portion core 12 is, the improvement effect on the DC superposition characteristic becomes better. The space can be determined based on their dimensional accuracy.

The larger the outer periphery of the flange-like member 14 is, the improvement effect on the DC superposition characteristic becomes better. If the area of the flat plane in the flange-like member 14 opposite to the yoke portion core 11 is 30% or more of the sectional area of the winding portion core, the improvement effect can be provided. Preferably, if the area of the flat plane in the flange-like member 14 opposite to the yoke portion core 11 is 50% or more of the sectional area of the winding portion core, the improvement effect can be sufficiently provided. The size of the outer periphery in the flange-like member 14 can be designed to be not larger than the area (length×width) of the opposite yoke portion core 11. If the flange-like member 14 protrudes compared to the yoke portion core 11, and the larger the protruding part is, the larger the flange-like member is, the effect on the flow of the magnetic flux is small with respect to the protruding part. If the yoke portion core 11 is increased in order to avoid such a problem, the effect of miniaturization will not be obtained.

The thicker the flange-like member 14 is, the better the improvement effect on the DC superposition characteristic is. If the thickness of the flange-like member 14 is 0.5 mm or more, the sufficient effect can be provided. If the thickness of the flange-like member 14 is 0.5 mm or more, the magnetic flux flowing through the flange-like member 14 can be sufficiently ensured and the inductance under DC superposition can sufficiently increase. If the thickness of the flange-like member 14 is less than 0.5 mm, the improvement effect on the DC superposition characteristic can be still provided but the effect deteriorates. In addition, in the terms of strength, the shape is likely to change, and thus it is difficult to deal with. If the thickness of the flange-like member 14 is excessively large, the length of the winding portion core 12 has to be increased to avoid the interference in structure with the wound coil 13. Thus, the thickness can be selected by considering both the interference with the coil 13 and the sufficient effect.

At least one set of the winding portion core 12 is disposed between the opposite yoke magnetic cores 11. From the viewpoint of miniaturization, it is preferable that one set or two sets of winding portion core(s) 12 is/are present.

According to the number of the sets of the winding portion core 12, the number of the parts where the yoke portion core 11 and the winding portion core 12 face to each other will change accordingly. However, if the flange-like member 14 is disposed at all these parts, the best effect will be obtained in the improvement of the inductance.

One set of the winding portion core 12 can be composed of one soft magnetic metal core. Alternatively, the one soft magnetic metal core can be separated into two or more to form one set of the winding portion core.

A gap 15 for adjusting the magnetic permeability can also be disposed in the path of the magnetic loop formed by the yoke portion core 11 and the winding portion core 12. The gap 15 is a space and can be made of a nonmagnetic and insulating material such as the ceramics, the glass, an epoxy glass substrate or a resin film. No matter the gap 15 is present or not, the effect of inductance improvement produced in the present invention can be provided. And the use of the gap 15 can make it more freely in the design of the reactor 10, i.e., the reactor 10 can be designed to have an arbitrary inductance. The position where the gap 15 is disposed is not particularly restricted, but the gap 15 is preferably inserted into the space between the yoke portion core 11 and a plane formed by the end plane of the winding portion core 12 and the flat plane of the flange-like member 14 from the viewpoint of easy operation.

Figure 2A:
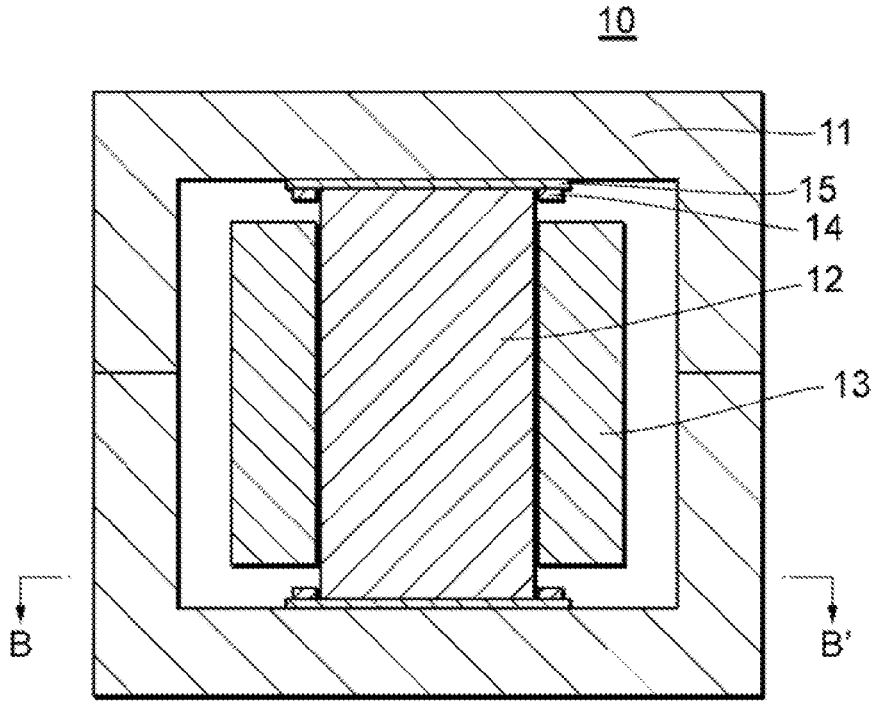
FIGS. 2A and 2B are a sectional view showing the configuration of the reactor according to another embodiment of the present invention.
Figure 2B:
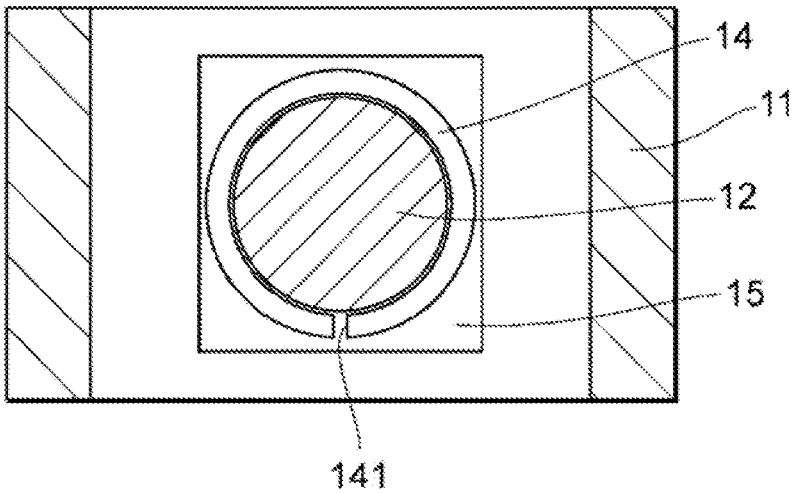

FIGS. 2A and 2B are a sectional view showing the configuration of the reactor according to another embodiment of the present invention. The yoke portion core 11 is a ferrite core shaped like "⊐" and is provided with a back portion and foot portions at both ends. The winding portion core 12 is the soft magnetic metal core. The yoke portion cores 11 are opposite to each other to form a "回" shaped magnetic loop as shown in FIGS. 2A and 2B. One set of winding portion core 12 is disposed at the central part of the opposite yoke portion cores 11, and the flange-like member 14 is disposed at the end part of the winding portion core 12 in a way of being external connected with the periphery of the winding portion core 12. The flange-like member 14 is more preferably to be disposed at both ends of the winding portion core 12. The embodiment shown in FIGS. 2A and 2B is substantially the same as that shown in FIGS. 1A and 1B except for the shape of the yoke portion core 11.

The preferable embodiments of the present invention have been described above. However, the present invention is not limited to these embodiments. The present invention can be variously modified without departing from the spirit and scope.

EXAMPLES

Example 1

With respect to the embodiments shown in FIGS. 1A and 1B and FIGS. 3A and 3B, the properties were compared based on the presence of the flange-like member 14.

A rectangular MnZn ferrite core (PE22, produced by TDK Corporation) was used as the yoke portion core, and two samples were prepared with a length of 80 mm, a width of 45 mm and a thickness of 20 mm.

A FeSi alloy powder magnetic core was used for the winding portion core. The FeSi alloy powder had a composition of Fe-4.5% Si. The alloy powder was prepared by a water atomization method, and the particle size was adjusted by a sieving process to an average particle diameter of 50 μm. A silicone resin was added into the obtained FeSi alloy powder in an amount of 2 mass %, and the mixture was mixed for 30 minutes at room temperature by using a pressurized kneader. Then, the resin was coated on the surface of the soft magnetic powder. The resultant mixture was subjected to a granulation process by using a screen mesh with an aperture of 355 μm to obtain particles. The obtained particles were filled into a mold coated with zinc stearate as the lubricant agent, and a pressure molding was performed under a molding pressure of 980 MPa to provide a molded body with a height of 25 mm and a diameter of 24 mm. The molded body was annealed at 700° C. under a nitrogen atmosphere. Two of the obtained FeSi alloy powder magnetic cores were bonded to provide a set of winding portion core, and two sets were prepared.

Example 1-1

In the embodiment of FIGS. 1A and 1B, an iron powder magnetic core was used for the flange-like member. The shape of the flange-like member was like that of a spacer, and this member was prepared with a shape as shown in FIG. 8. The flange-like member had an outer diameter of 35 mm, an inner diameter of 24 mm and a thickness of 1.0 mm. The Somaloy 110 produced by Höganäs AB Corporation was used as the iron powder. The iron powder was filled into a mold coated with zinc stearate as the lubricant agent and was then subjected to a pressure molding under a pressure of 780 MPa to provide a molded body. The molded body was annealed at 500° C. to obtain four flange-like members.

The flange-like member was inserted into both ends of the winding portion core, and its position was adjusted such that the end plane of the winding portion core was in the same height with the flat plane of the flange-like member. Then, the flange-like member was fixed by using a binder. The two sets of winding portion cores with the flange-like members were disposed between the two yoke portion cores opposite to each other, and a coil with a number of turns of 44 was wound around the winding portion core so as to provide a reactor (Example 1-1).

Comparative Example 1-1

Figure 3A:
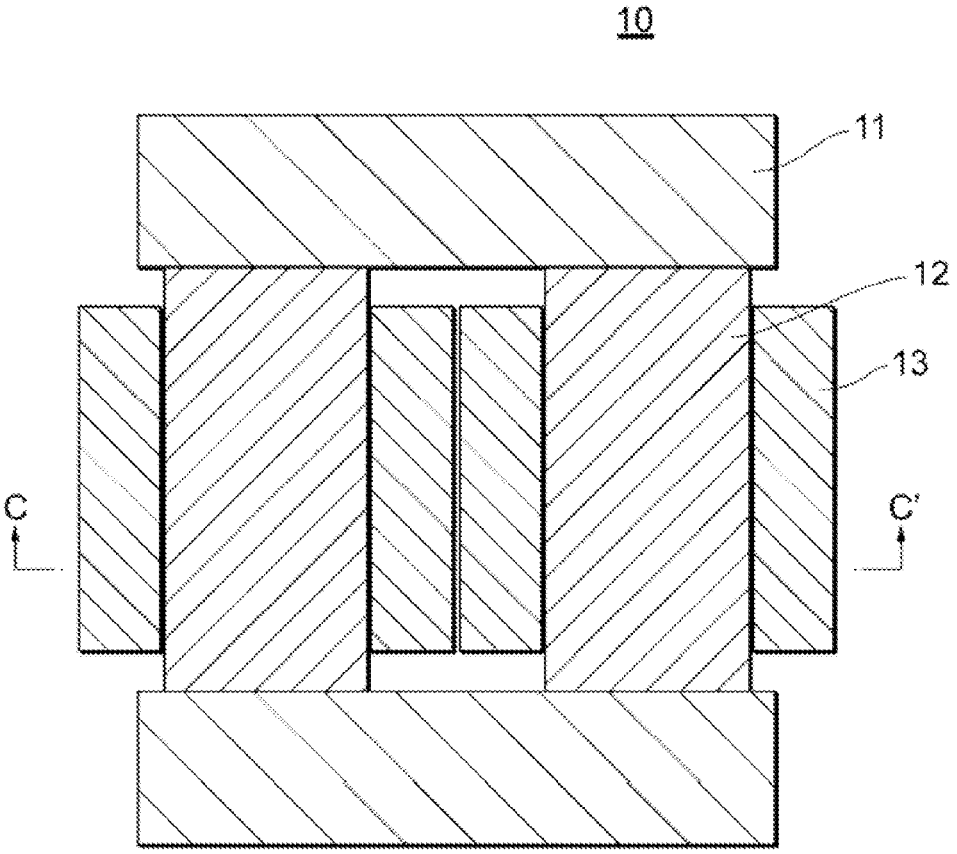
Prior Art Fig. 3A
FIGS. 3A and 3B are a sectional view showing the configuration of the reactor in the prior art.
Figure 3B:
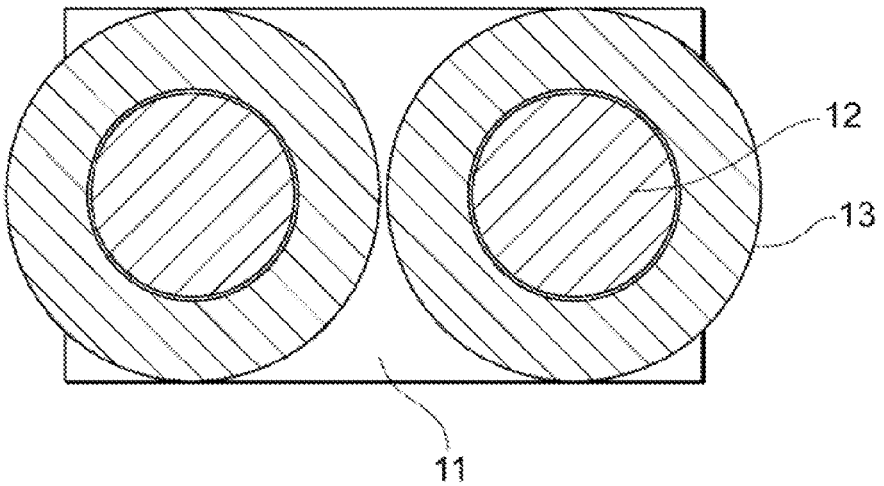
Prior Art Fig. 3B
Figure 4:
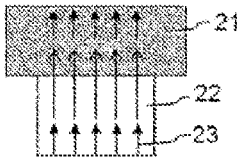
Prior Art Fig. 4
FIG. 4 is a drawing schematically showing the configuration of the junction portion of the ferrite core and the soft magnetic metal core as well as the flow of the magnetic flux in the prior art.
Figure 5:
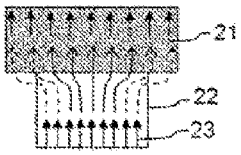
Prior Art Fig. 5
FIG. 5 is a drawing schematically showing the configuration of the junction portion of the ferrite core and the soft magnetic metal core as well as the flow of the magnetic flux in the prior art.

In the embodiment of FIGS. 3A and 3B, the properties of the conventional configuration were evaluated in which no flange-like member was disposed at the end part of the winding portion core. A reactor was prepared as in Example 1-1 except that no flange-like member was disposed at the end part of the winding portion core (Comparative Example 1-1).

The inductance and the iron loss at a high frequency were evaluated in the obtained reactors (Example 1-1 and Comparative Example 1-1).

The DC superposition characteristic of the inductance was measured by using a LCR meter (4284A, produced by Agilent Technologies Inc.) and a DC bias supply (42841A, produced by Agilent Technologies Inc.). The gap 15 was not inserted with a design in which the initial inductance was 600 μm when no DC current was applied. With respect to the DC superposition characteristic, the inductance was measured when the rated current was 20 A. The DC superposition characteristic was shown in Table 1.

The iron loss at a high frequency was measured by using a BH analyzer (SY-8258, produced by Iwatsu Test Instruments Corporation). The core loss was measured under a condition of f=20 kHz and Bm=50 mT. The coils with the number of turns of the excitation coil being 25 and the number of turns of the search coil being 5 were wound around one winding portion core, and then the measurement was performed. The results in the measurement of the iron loss at a high frequency were shown in Table 1.

Examples 2-1 to 2-3 and Comparative Example 2-1

In these examples, no gap 15 was inserted, and the yoke portion core 11, the winding portion core 12 and the coil 13 were the same as those in Example 1.

The flange-like member was shaped like a spacer with an outer diameter of 35 mm, an inner diameter of 24 mm and a thickness of 1.0 mm. The materials for the flange-like member were respectively a carbon steel (S45C) in Example 2-1, a cold-rolled steel plate in Example 2-2, an electromagnetic steel plate in Example 2-3 and an austenite based stainless steel (SUS304) in Comparative Example 2-1 which were all materials using iron as the main component. As for the carbon steel, the cold-rolled steel plate and the austenite based stainless steel (SUS304), the commercially available metal washer and the shim ring (produced by, for example, Misumi Group Inc.) were used. A notch with a width of 1 mm was formed in the part of the periphery by using a fine cutter. The notch reached the inner periphery from the outer periphery with a shape shown in FIG. 9. The electromagnetic steel plate which was a non-oriented one with a thickness of 0.1 mm was cut into a spacer like shape, and then several of them were stacked. A notch with a width of about 1 mm was formed from the central part of one side of the outer periphery to the inner periphery by using a fine cutter so that the shape was formed as shown in FIG. 9. In addition, the non-oriented electromagnetic steel plate with a width of 0.1 mm was cut in a way of becoming a square with one side of 40 mm. Then, a hole with a diameter of 24 mm was formed in the central part, and a notch with a width of about 1 mm was formed from the central part of one side of the outer periphery to the inner periphery by using a fine cutter. Then, the steel plates were stacked to have a total thickness of 1.0 mm to have the shape as shown in FIG. 12 (Example 2-4).

TABLE 1

| | No. | Material for flange-like member | Inner diameter of flange-life member [mm] | Outer diameter of flange-like member [mm] | Thickness of flange-like member [mm] | Inductance L at 0 A [μH] | Inductance L at 20 A [μH] | Reduction rate of L ΔL/L0 | Iron loss at a high frequency Pc 20 kHz, 50 mT [W] |
|---|---|---|---|---|---|---|---|---|---|
| Comparative Example | 1-1 | None | — | — | — | 600 | 350 | −42% | 1.7 |
| Example | 1-1 | Iron powder magnetic core | 24 | 35 | 1.0 | 600 | 480 | −20% | 1.6 |

It could be known from Table 1 that in Comparative Example 1-1 with a conventional configuration, the inductance at a current with DC superposition of 20 A was as low as 350 μH which was decreased by 40% or more compared to the initial inductance (600 μH). In the reactor of Example 1-1, as the flange-like member was disposed at the end part of the winding portion core, the improvement effect on the inductance at a current with DC superposition of 20 A was sufficient. The value of the inductance was 450 μH or more which was decreased by 30% or less. In addition, the iron loss at a high frequency in the reactor of Example 1-1 was not increased compared to Comparative Example 1-1 in which no flange-like member was provided.

Example 2

With respect to the embodiment shown in FIGS. 1A and 1B, the properties were compared based on the different material for the flange-like member 14.

The prepared flange-like member was made close to a ferrite magnet to test whether it was capable of being attracted to the magnet or not. The results were shown in Table 2. The carbon steel, the cold-rolled steel plate and the non-oriented electromagnetic steel plate could be attracted to the magnet but the austenite based stainless steel (SUS304) could not be attracted to the magnet.

The flange-like member was inserted into both ends of the winding portion core, and the position was adjusted such that the end plane of the winding portion core was in the same height with the flat plane of the flange-like member. Then, the flange-like member was fixed by using a binder. The two sets of winding portion cores with the flange-like members were disposed between two yoke portion cores opposite to each other, and coils with the number of turns of 44 were wound around the winding portion cores so as to provide a reactor (Examples 2-1 to 2-4 and Comparative Example 2-1).

The inductance and the iron loss at a high frequency were evaluated in the obtained reactors (Examples 2-1 to 2-4 and Comparative Example 2-1) as in Example 1, and the results were shown in Table 2.

TABLE 2

| | No. | Material for flange-like member | Attraction of flange-like member to magnet | Inner diameter of flange-like member [mm] | Outer diameter of flange-like member [mm] | Thickness of flange-like member [mm] | Inductance L at 0 A [μH] | Inductance L at 20 A [μH] | Reduction rate of L ΔL/L0 | Iron loss at a high frequency Pc 20 kHz, 50 mT [W] |
|---|---|---|---|---|---|---|---|---|---|---|
| Example | 2-1 | Carbon steel | Yes | 24 | 35 | 1.0 | 600 | 470 | −22% | 1.8 |
| Example | 2-2 | Cold-rolled steel plate | Yes | 24 | 35 | 1.0 | 600 | 480 | −20% | 1.7 |
| Example | 2-3 | Electromagnetic steel plate | Yes | 24 | 35 | 1.0 | 600 | 480 | −20% | 1.7 |
| Example | 2-4 | Electromagnetic steel plate | Yes | 24 | (□40 × 40) | 1.0 | 600 | 480 | −20% | 1.7 |
| Comparative Example | 2-1 | SUS304 | No | 24 | 35 | 1.0 | 600 | 350 | −42% | 1.7 |

In Comparative Example 2-1, the inductance at a current with DC superposition of 20 A was as low as 350 μH which was decreased by 40% or more compared to the initial inductance (600 μH). Such DC superposition characteristic was the same as that in Comparative Example 1-1. As the flange-like member made of austenite based stainless steel (SUS304) could not be attracted to the magnet, little magnetic flux flowed through it and the magnetic saturation on the junction portion of the ferrite core and the soft magnetic metal core could not be improved. In this respect, similar to the conventional embodiment in which no flange-like member was disposed, the inductance under DC superposition reduced.

On the other hand, as the flange-like members in the reactors of Examples 2-1 to 2-4 were made of iron based metal materials which could be attracted to the magnet, a big magnetic flux flowed through the flange-like member. Thus, the inductance under DC superposition was sufficiently improved. Specifically, the values of the inductance were 450 μH or more which were decreased by 30% or less compared to the initial inductance.

Further, compared to the Comparative Example 1-1 in which no flange-like member was disposed, the iron loss at a high frequency was almost equivalent in the reactors of Examples 2-1 to 2-4. The carbon steel, the cold-rolled steel plate and the electromagnetic steel plate were metal materials which had a low resistance on the in-plane direction of the flat plane. The flow of the eddy current generated when a magnetic field with a high frequency was applied could be cut off by disposing the notch from the inner periphery to the outer periphery at a place in the peripheral direction. As the generation of the eddy current was inhibited, the iron loss at a high frequency did not increase. As a result, an equivalent iron loss at a high frequency could be obtained no matter the flange-like member was present or not.

Furthermore, the outer peripheries of the flange-like members in the reactors of Examples 2-1 to 2-3 were roughly circular while the outer periphery of the flange-like members in the reactors of Example 2-4 was roughly quadrilateral. The improvement effect on the inductance under DC superposition was sufficient in any of these cases. Specifically, the values of the inductance were 450 μH or more which were decreased by 30% or less compared to the initial inductances. As such, the improvement effect on the DC superposition characteristic could be provided no matter how the outer periphery of the flange-like member was shaped.

Example 3

With respect to the embodiment shown in FIGS. 1A and 1B, the properties were compared based on the size of the flange-like member 14.

Examples 3-1 to 3-8

In these examples, no gap 15 was inserted, and the yoke portion core 11, the winding portion core 12 and the coil 13 were the same as those in Example 1.

The flange-like member was shaped like a spacer, and the material was the cold-rolled steel plate. The outer diameter, the inner diameter, the thickness and the width of the notch were shown in Table 3. The commercially available shim rings were used as the flange-like members. A notch with a width of 1 mm was formed at the part of the periphery by using a fine cutter. The notch reached the inner periphery from the outer periphery to provide the shape shown in FIG. 9. In addition, a commercially available split-type shim (for example, produced by Misumi Group Inc.) was used as the flange-like member in which the width of the notch was the same with the inner diameter (25 mm) (Example 3-8) to obtain the shape shown in FIG. 10.

The flange-like member was inserted into both ends of the winding portion core, and the position was adjusted such that the end plane of the winding portion core was in the same height with the flat plane of the flange-like member. Then, the flange-like member was fixed by using a binder. When the space between the outer periphery of the winding portion core and the inner periphery of the flange-like member was large, the outer periphery of the winding portion core was brought into contact with a part of the inner periphery of the flange-like member. Then, the flange-like member was fixed with the space filled by a binder. Two sets of winding portion cores with the flange-like members were disposed between two yoke portion cores opposite to each other, and coils with the number of turns of 44 were wound around the winding portion core so as to provide a reactor (Examples 3-1 to 3-8).

The inductance and the iron loss at a high frequency were evaluated in the obtained reactors (Examples 3-1 to 3-8) as in Example 1, and the results were shown in Table 3.

TABLE 3

| | No. | Material for flange-like member | Inner diameter of flange-like member [mm] | Outer diameter of flange-like member [mm] | Thickness of flange-like member [mm] | Width of notch at flange-like member [mm] | Area of flat part of flange-like member S2 [mm$^2$] | Sectional area of winding portion core S1 [mm$^2$] |
|---|---|---|---|---|---|---|---|---|
| Example | 3-1 | Cold-rolled steel plate | 24 | 28 | 1.0 | 1.0 | 163 | 452 |
| Example | 3-2 | Cold-rolled steel plate | 24 | 30 | 1.0 | 1.0 | 254 | 452 |
| Example | 3-3 | Cold-rolled steel plate | 24 | 32 | 1.0 | 1.0 | 352 | 452 |
| Example | 3-4 | Cold-rolled steel plate | 24 | 35 | 1.0 | 1.0 | 510 | 452 |
| Example | 3-5 | Cold-rolled steel plate | 24 | 40 | 1.0 | 1.0 | 804 | 452 |
| Example | 3-6 | Cold-rolled steel plate | 24 | 35 | 0.5 | 1.0 | 510 | 452 |
| Example | 3-7 | Cold-rolled steel plate | 25 | 35 | 1.0 | 1.0 | 471 | 452 |
| Example | 3-8 | Cold-rolled steel plate | 25 | 35 | 1.0 | 25.0 | 279 | 452 |

| | No. | Area ratio S2/S1 | Inductance L at 0 A [μH] | Inductance L at 20 A [μH] | Reduction rate of L ΔL/L0 | Iron loss at a high frequency Pc 20 kHz, 50 mT [W] |
|---|---|---|---|---|---|---|
| Example | 3-1 | 0.36 | 600 | 450 | −25% | 1.7 |
| Example | 3-2 | 0.56 | 600 | 470 | −22% | 1.7 |
| Example | 3-3 | 0.78 | 600 | 470 | −22% | 1.7 |
| Example | 3-4 | 1.13 | 600 | 480 | −20% | 1.7 |
| Example | 3-5 | 1.78 | 600 | 480 | −20% | 1.7 |
| Example | 3-6 | 1.13 | 600 | 470 | −22% | 1.7 |
| Example | 3-7 | 1.04 | 600 | 450 | −25% | 1.8 |
| Example | 3-8 | 0.62 | 600 | 460 | −23% | 1.7 |

In Examples 3-1 to 3-8, the improvement effect on the inductance under DC superposition was sufficient in any case. Specifically, the values of the inductance were 450 μH or more which were decreased by 30% or less compared to the initial inductances.

In Examples 3-1 to 3-5, the cases with outer diameter of the flange-like member being changed were compared. In Example 3-1, the area of the flat part of the flange-like member S2 was 163 mm$^2$, and the ratio of the area of the flat part S2 to the sectional area of the winding portion core S1 (452 mm$^2$) (S2/S1) was 36%. Thus, if the ratio of the area of the flat part of the flange-like member S2 to the sectional area of the winding portion core S1 (S2/S1) was 30% or more, the inductance under DC superposition could be improved. In Examples 3-1 to 3-5, as the outer diameter of the flange-like member became larger, the inductance under DC superposition tended to increase. However, when the outer diameter was 30 mm or more, the effect was almost constant. When the outer diameter was 30 mm (Example 3-2), the ratio of the area of the flat part of the flange-like member S2 (254 mm$^2$) to the sectional area of the winding portion core S1 (S2/S1) was 56%. Therefore, if the ratio of the area of the flat part of the flange-like member S2 to the sectional area of the winding portion core S1 (S2/S1) was 50% or more, the inductance under DC superposition was sufficiently improved.

In Example 3-4 and Example 3-7, the cases with the inner diameter of the flange-like member being changed were compared. In Example 3-7, the inner diameter of the flange-like member was larger than the outer diameter of the winding portion core by 1.0 mm, the inductance under DC superposition tended to decrease compared to that in Example 3-4. Specifically, the value of the inductance was 450 μH or more which was decreased by 30% or less compared to the initial inductance. Hence, if the space between the inner diameter of the flange-like member and the outer diameter of the winding portion core was 0.5 mm or less, the size of the inner periphery of the flange-like member could be freely selected by considering the dimensional accuracy of the inner periphery of the flange-like member and the dimensional accuracy of the outer periphery of the end part of the winding portion core.

In Example 3-4 and Example 3-6, the cases with the thickness of the flange-like member being changed were compared. The same value of inductance was obtained in either case which was decreased by 30% or less compared to the initial inductance. Thus, if the thickness of the flange-like member was 0.5 mm or more, the improvement effect on the inductance under DC superposition was sufficient.

In Example 3-7 and Example 3-8, the cases with the width of the notch in the flange-like member being changed were compared. In Example 3-7, the width of the notch was 1.0 mm, and the effect on the area of the flat part of the flange-like member could be almost neglected. In Example 3-8, the width of the notch was the same with the inner diameter of the flange-like member, and the area of the flat part of the flange-like member was reduced due to the notch. However, the remaining area occupied 60% or more of the sectional area of the winding portion core which was sufficient to improve the inductance under DC superposition. The same value of the inductance was obtained in either case which was decreased by 30% or less compared to the initial inductance. In addition, the increases of the iron loss at a high frequency were within 10% which was not a problem. Therefore, the improvement effect was sufficient as long as the electric conduction was cut off at the periphery direction even if the notch part of the flange-like member had a small width of about 1 mm or even if the width of the notch almost equaled to the inner diameter of the flange-like member.

Example 4

With respect to the embodiment shown in FIGS. 2A and 2B, the properties where compared based on the presence of the flange-like member 14 and its size.

The yoke portion core 11 was a MnZn ferrite core shaped like "□" (PC90, produced by TDK Corporation), wherein, the back portion had a length of 80 mm, a width of 60 mm and a thickness of 10 mm, and the foot portion had a length of 14 mm, a width of 60 mm and a thickness of 10 mm.

The FeSi alloy powder magnetic core was used for the winding portion core 12. It was shaped into a cylinder with a diameter of 24 mm and a height of 26 mm and was prepared as in Example 1.

Examples 4-1 and 4-2

The flange-like member was shaped like a spacer, and the material was the cold-rolled steel plate. The outer diameter, the inner diameter and the thickness were shown in Table 4. The commercially available shim ring was used as the flange-like member, and a notch with a width of 1 mm was formed at a part of the periphery by using a fine cutter. The notch reached the inner periphery from the outer periphery to provide the shape shown in FIG. 9.

with a number of turns of 38 was wound around the winding portion core so as to provide a reactor (Examples 4-1 to 4-2).

Comparative Example 4-1

A reactor was prepared as in Example 4-1 except that no flange-like member was disposed at the end part of the winding portion core (Comparative Example 4-1).

The inductance and the iron loss at a high frequency were evaluated in the obtained reactors (Examples 4-1 to 4-2 and Comparative Example 4-1).

The DC superposition characteristic of the inductance was measured as in Example 1. A material for gap with a thickness of 0.5 mm was inserted into two spaces between the junction portion core and the winding portion core in a manner that the initial inductance was 530 μH when no DC current was applied. The PET (polyethylene terephthalate) resin film was used as the non-magnetic and insulating material for gap. Before the material for gap was to be inserted, the height of the foot portion was adjusted by grinding the foot portion so as to eliminate the space between the foot portions of the opposite ferrite cores. The inductance was measured when the rated current was 20 A to show the DC superposition characteristic, and the results were shown in Table 4.

The iron loss at a high frequency was measured as in Example 1. The f was set to be 20 kHz and Bm was set to be 50 mT in the measurement of the core loss. The excitation coil had a number of turns of 25 and the search coil had a number of turns of 5. These two coils were wound around the winding portion core to perform the measurement. The results in the measurement of iron loss were shown in Table 4.

TABLE 4

| | No. | Material for flange-like member | Inner diameter of flange-like member [mm] | Outer diameter of flange-like member [mm] | Thickness of flange-like member [mm] | Width of notch at flange-like member [mm] | Area of flat part of flange-like member S2 [mm$^2$] | Sectional area of winding portion S1 [mm$^2$] |
|---|---|---|---|---|---|---|---|---|
| Comparative Example | 4-1 | None | — | — | — | — | — | 452 |
| Example | 4-1 | Cold-rolled steel plate | 24 | 35 | 1.0 | 1.0 | 510 | 452 |
| Example | 4-2 | Cold-rolled steel plate | 24 | 55 | 1.0 | 1.0 | 1923 | 452 |

| | No. | Area ratio S2/S1 | Gap [mm] | Inductance L at 0 A [μH] | Inductance L at 20 A [μH] | Reduction rate of L ΔL/L0 | Iron loss at a high frequency Pc 20 kHz, 50 mT [W] |
|---|---|---|---|---|---|---|---|
| Comparative Example | 4-1 | — | 0.50 | 530 | 310 | −42% | 0.9 |
| Example | 4-1 | 1.13 | 0.50 | 530 | 450 | −15% | 0.9 |
| Example | 4-2 | 4.26 | 0.50 | 530 | 450 | −15% | 0.9 |

The flange-like member was inserted into both ends of the winding portion core, and the position was adjusted such that the end plane of the winding portion core was in the same height with the flat plane of the flange-like member. Then, the flange-like member was fixed by using a binder. One set of winding portion cores with the flange-like members was disposed at the central part of the yoke portion cores which were opposite to each other by forming a "□" shaped magnetic loop as shown in FIGS. 2A and 2B. A coil It could be seen from Table 4 that in the reactor of Comparative Example 4-1, the inductance at a current with DC superposition of 20 A was as low as 310 μH which was decreased by 40% or more compared to the initial inductance (530 μH). On the other hand, in the reactors of Examples 4-1 to 4-2, the inductance at a current with DC superposition of 20 A was 450 μH which was decreased by 30% or less compared to the initial inductance (530 μH). In addition, the increase of the iron loss at a high frequency was not observed.

In Examples 4-1 and 4-2, a gap (0.5 mm) was inserted between the yoke portion core and the winding portion core. The inductance under DC superposition was decreased by 30% or less compared to the initial inductance (530 μH). Therefore, with the insertion of the gap at the space between the yoke portion core and the winding portion core, the improvement effect on the inductance under DC superposition would not deteriorate and the initial inductance could be easily adjusted.

As described above, the reactor of the present invention has the loss decreased and also has a high inductance even under DC superposition so that a high efficiency and miniaturization can be realized. Therefore, such a reactor can be widely and effectively used in an electromagnetic device such as a power supply circuit or a power conditioner.

DESCRIPTION OF REFERENCE NUMERALS

10: reactor
11: yoke portion core
12: winding portion core
13: coil
14: flange-like member
141: notch part of flange-like member
15: gap
21: ferrite core
22: soft magnetic metal core
23: magnetic flux
24: flange-like member

What is claimed is:

1. A reactor comprising:

a pair of yoke portion cores composed of ferrite cores and arranged opposing each other, one or more winding portion cores disposed between opposite planes of said yoke portion cores, each of the one or more winding portion cores having opposing end surfaces, and one or more coils each wound around a corresponding one of the one or more winding portion cores, wherein:

one or more flange-like members are each disposed at an end part of a corresponding one of the winding portion cores in a way of being externally connected with a periphery of said corresponding one of the one or more winding portion cores, each of said one or more flange-like members being a separate element from the corresponding winding portion core and having an outer surface, each of said one or more winding portion cores is composed of a soft magnetic metal core, each one of the opposing end surfaces of the one or more winding portion cores is in the same plane as the outer surface of one of the one or more flange-like members, and each of said one or more flange-like members is a homogenous steel plate in which a notch from an inner peripheral end to an outer peripheral end is provided at one place in a peripheral direction.

2. The reactor according to claim 1, wherein, each of said one or more flange-like members is composed of a soft magnetic metal powder core.

3. The reactor according to claim 1, each of said one or more flange-like members being composed of a material different from a material of which the corresponding one of the one or more winding portion cores is composed.

4. The reactor according to claim 1, wherein:

the one or more flange-like members extend radially a distance less than the radial width of the one or more coils;

each of the one or more flange-like members has an inner surface; and the one or more coils have outer surfaces that are spaced inwardly from the inner surfaces of the one or more flange-like members.

5. The reactor according to claim 1, wherein the one or more flange-like members have an outer periphery that is not circular.

6. The reactor according to claim 5, wherein the outer periphery of the one or more flange-like members is substantially rectangular.

7. The reactor according to claim 1, wherein there are gaps between (1) the opposing end surfaces of the one or more winding portion cores and the outer surfaces of the one or more flange-like members and (2) the pair of yoke portion cores.

8. The reactor according to claim 7, wherein the gaps include insulating material.

* * * * *